US006890213B2

(12) United States Patent
Ohtsuki

(10) Patent No.: US 6,890,213 B2
(45) Date of Patent: May 10, 2005

(54) ELECTRICAL CONNECTOR

(75) Inventor: Tomonari Ohtsuki, Tokyo (JP)

(73) Assignee: DDK Ltd., Tokyo (JP)

( * ) Notice: Subject to any disclaimer, the term of this patent is extended or adjusted under 35 U.S.C. 154(b) by 0 days.

(21) Appl. No.: 10/197,018

(22) Filed: Jul. 16, 2002

(65) Prior Publication Data

US 2003/0104724 A1 Jun. 5, 2003

(30) Foreign Application Priority Data

Nov. 30, 2001 (JP) ..... 2001-366179

(51) Int. Cl.[7] ..... H01R 13/648
(52) U.S. Cl. ..... 439/607; 439/931
(58) Field of Search ..... 439/607–610, 439/931

(56) References Cited

U.S. PATENT DOCUMENTS 5,037,332 A * 8/1991 Wilson ..... 439/608
5,228,871 A * 7/1993 Goodman ..... 439/607
5,647,768 A * 7/1997 Messuri et al. ..... 439/620

* cited by examiner

*Primary Examiner*—Gary Paumen
(74) *Attorney, Agent, or Firm*—Baker Botts L.L.P.

(57) ABSTRACT

An electrical connector includes an insulator and a plurality of contacts supported by the insulator. The insulator formed of an insulating plastic material is formed with a plurality of contact insertion apertures for inserting the contacts. Surfaces of the insulator around the contact insertion apertures are metallized, while the contact insertion apertures are independently electrically insulated. With this arrangement, substantially high shielding effect and sufficiently high speed information transmission are effectively accomplished.

15 Claims, 4 Drawing Sheets

ELECTRICAL CONNECTOR

BACKGROUND OF THE INVENTION

This invention relates to an electrical connector for use in electric and electronic appliances and more particularly to an electrical connector improved in shielding to deal with high-speed information transmission.

FIG. 6 partly illustrates a hitherto used electrical connector viewed from a mating connector. Such an electrical connector of the prior art has a substantially rectangular parallelepiped configuration and includes mainly an insulator and contacts fixed thereto. These contacts may be divided into signal contacts ($+S_1$), phase inversion signal contacts ($-S_1$) with an inverted phase, and ground contacts (G). These contacts are arranged in a manner such that the signal contacts and the phase inversion signal contacts are in pairs and these pairs are surrounded by the ground contacts as shown in FIG. 6.

The signal, phase inversion signal and ground contacts are arranged in the insulator in the manner described above in order to improve the shielding effect to deal with high-speed transmission. Even with fine or narrow pitches of contacts, however, gaps between the ground contacts become rather wider so that shielding effect could not be sufficiently obtained and hence information transmission speed would be objectionably limited to values of the order of several hundreds mega bits per second.

SUMMARY OF THE INVENTION

It is an object of the invention to provide an improved electrical connector which eliminates all the disadvantages of the prior art and improves its shielding effect to deal with higher speed information transmission sufficiently.

In order to accomplish the object of the invention, in an electrical connector including a plurality of contacts and an insulator holding the contacts, according to the first aspect of the invention the insulator formed of an insulating plastic material is formed with contact insertion apertures for inserting the contacts, surfaces of the insulator around the contact insertion apertures being metallized and the contact insertion apertures being independently electrically insulated. With the metallized surfaces around the contact insertion apertures in this manner, gaps between shielding layers become narrower.

In another aspect of the invention, the insulator formed of an insulating plastic material is formed with pairs of contact insertion apertures for inserting the contacts, surfaces of the insulator around the pairs of contact insertion apertures being metallized and the pairs of contact insertion apertures being independently electrically insulated.

In a preferred embodiment of the invention, the contact insertion apertures are metallized apertures.

In a further aspect of the invention, the insulator formed of an insulating plastic material is formed with a plurality of contact insertion apertures for inserting the contacts, surfaces of the insulator around the contact insertion apertures and some of the contact insertion apertures being metallized and required number of the contact insertion apertures being independently electrically insulated.

Preferably, the insulator comprises a main body substantially in the form of a flat plate and a plurality of projections extending from the main body, and the projections and the main body are formed with a plurality of contact insertion apertures passing therethrough, the main body being entirely metallized and a required number of the contact insertion apertures being independently electrically insulated.

The term "metallizing" used herein means a treatment for coating an insulator with a metallic film to make electrically conductive the surface of the insulator.

The electrical connector having the subject features of the invention can bring about the following significant effects.

(1) According to the invention, since the surfaces around the contact insertion apertures for inserting the contacts are metallized, the effective shielding is obtained with great certainty to make possible higher information transmission speed.

(2) According to the invention, since the surfaces around a pair of contact insertion apertures for inserting the signal contact and the phase inversion signal contact are metallized, the effective shielding is obtained very reliably to deal with high-speed information transmission higher than several thousands mega bits per second.

(3) According to the invention, ground contacts can be easily grounded or earthed by merely inserting the ground contacts into the contact insertion apertures.

(4) According to the invention, when the contacts are pairs of signal contacts and ground contacts, the grand contacts are inserted into the contact insertion apertures so as to be grounded according to designated specifications of the connector to meet the requirements of the specifications with ease.

The invention will be more fully understood by referring to the following detailed specification and claims taken in connection with the appended drawings.

DESCRIPTION OF THE PREFERRED EMBODIMENTS

Figure 1A:
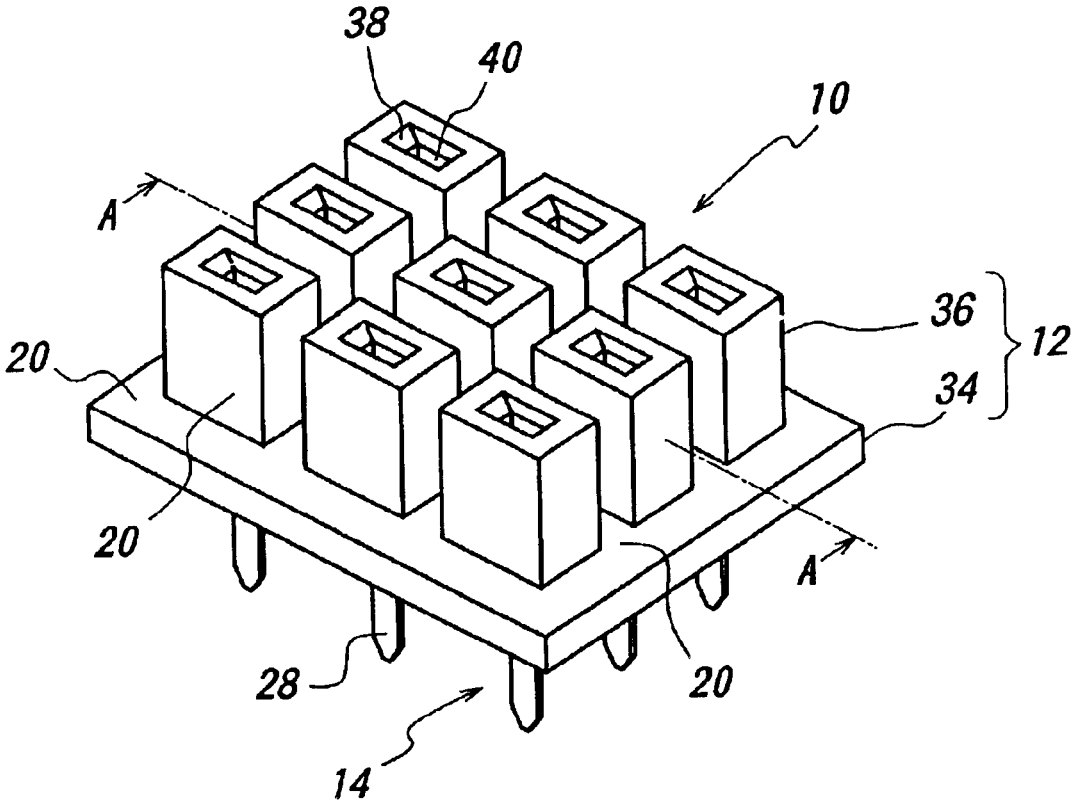
FIG. 1A is a perspective view of an electrical connector according to one aspect of the invention.
Figure 1B:
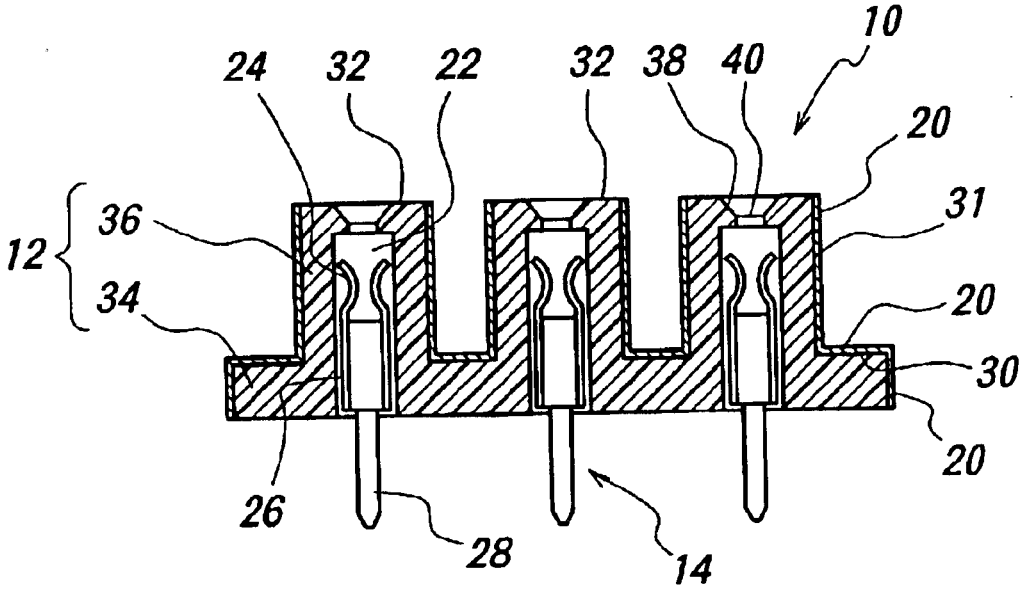
FIG. 1B is a sectional view of the electrical connector taken along a plane A—A in FIG. 1A.
Figure 2:
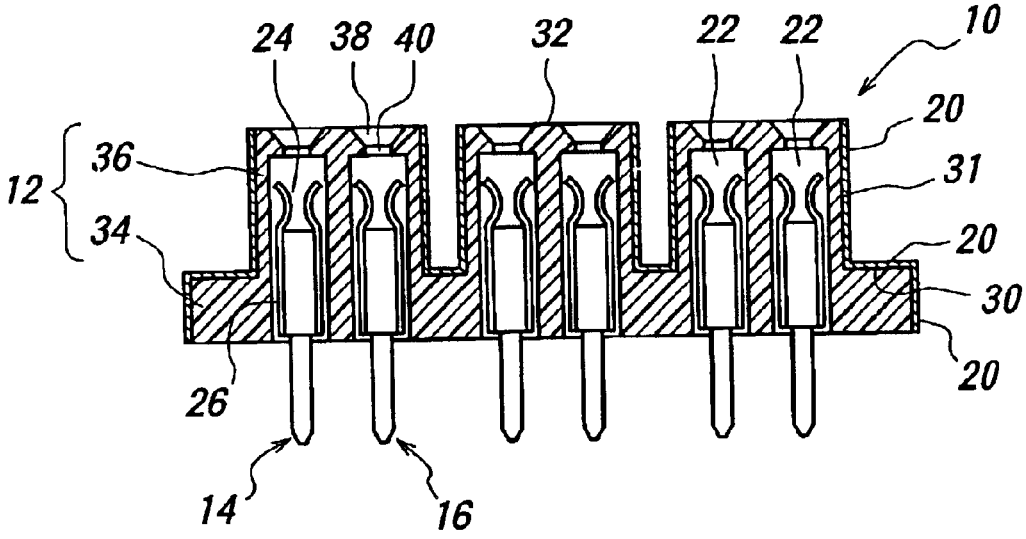
FIG. 2 is a sectional view of an electrical connector according to another aspect of the invention including metallized projections each having a pair of contact insertion apertures.
Figure 3:
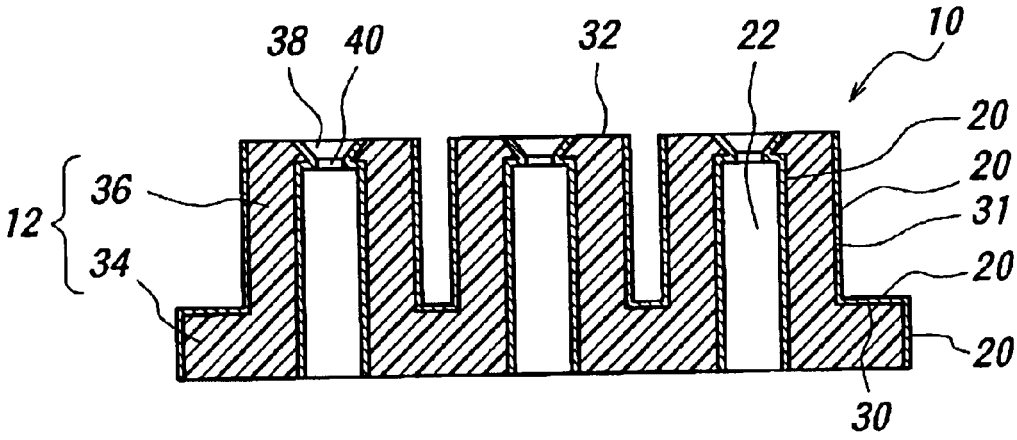
FIG. 3 is a sectional view of an electrical connector according to an embodiment of the invention illustrating metallized inner surfaces of contact insertion apertures.
Figure 4:
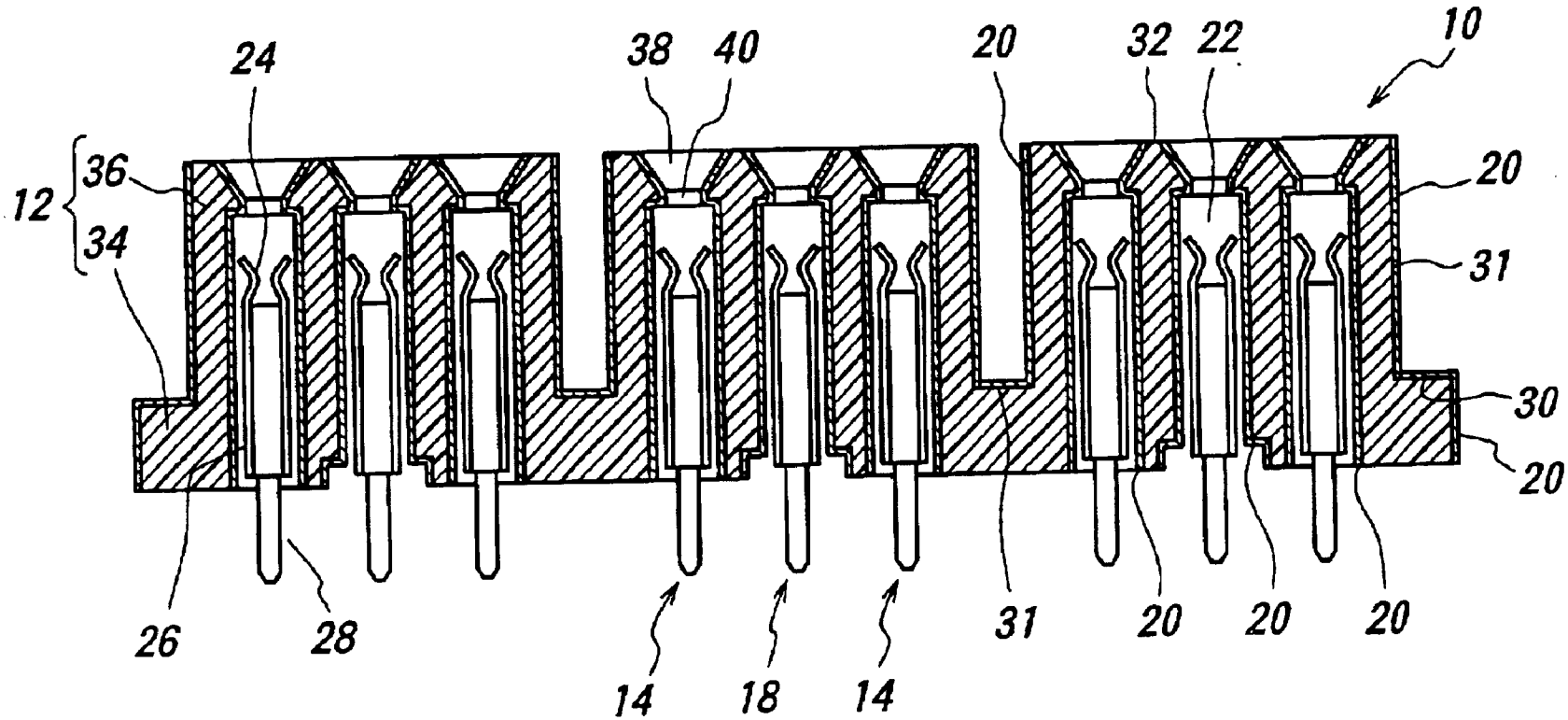
FIG. 4 is a sectional view of an electrical connector according to a further aspect of the invention including metallized projections each having three contact insertion apertures.
Figure 5:
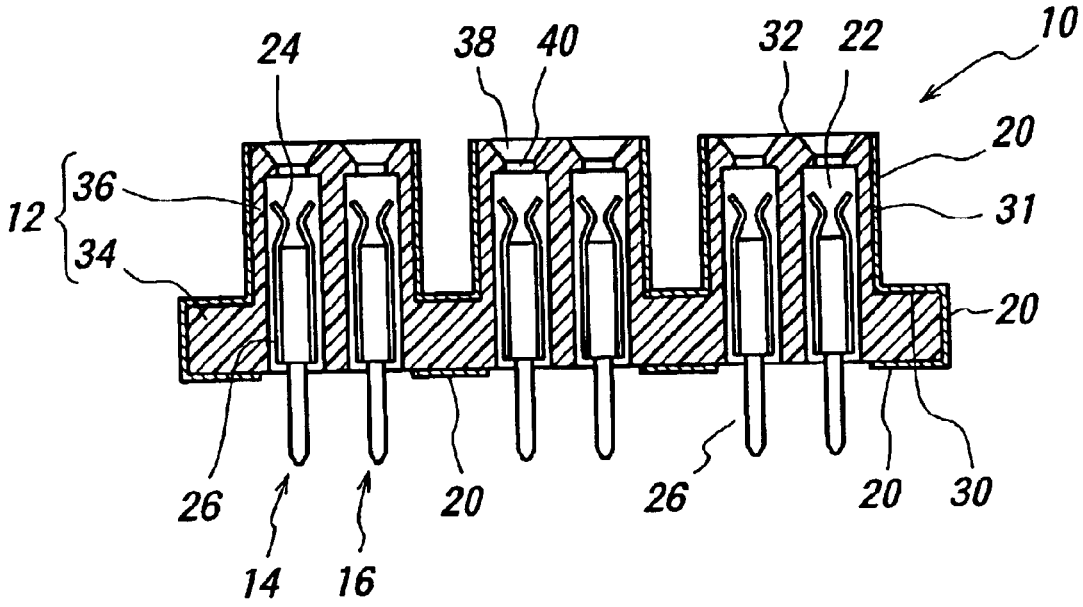
FIG. 5 is a sectional view of an electrical connector according to another embodiment of the invention whose main body of an insulator is metallized as a whole.
Figure 6:
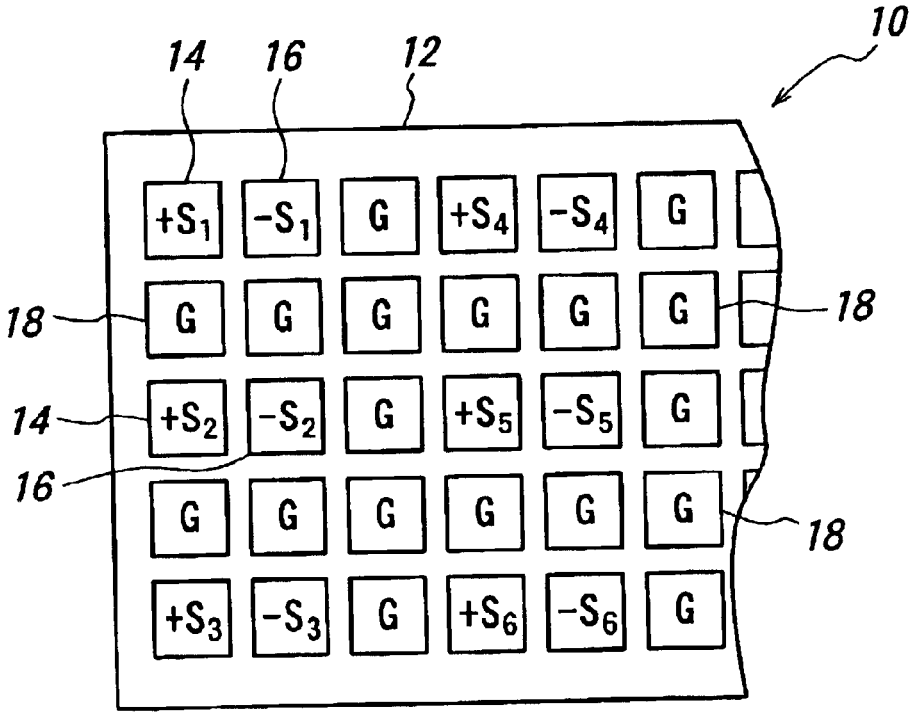
FIG. 6 PRIOR ART
FIG. 6 illustrates an electrical connector of the prior art viewed from the side of a mating connector.

FIG. 1A illustrates in a perspective view an electrical connector according to the first aspect of the invention whose cross-section is shown in FIG. 1B taken along a plane A—A in FIG. 1A. FIG. 2 illustrates, in a sectional view, metallized projections of the electrical connector each having a pair of contact insertion apertures. FIG. 3 shows contact insertion apertures with metallized inner surfaces. FIG. 4 illustrates metallized projections each having three contact insertion apertures. FIG. 5 shows a cross-section of an electrical connector illustrating a main body and a plurality of metallized projections extending therefrom.

The electrical connector 10 according to the invention shown in FIG. 1A comprises a plurality of contacts and an insulator 12. The contacts are divided into signal contacts 14 and phase inversion signal contacts 16.

The insulator 12 is injection molded from an electrically insulating plastic material in the conventional manner. Preferred materials from which to form the insulator 12 include polybutylene terephthalate (PBT), liquid crystal polymer (LCP), polyphenylene sulfide (PPS), polyamide (46PA or 66PA) and the like in view of the requirements imposed on such an insulator with respect to moldability and dimensional stability.

The contacts are made of a metal and formed by the press-working in the conventional manner. Preferred metals for the contacts are brass, phosphor bronze, beryllium copper and the like in consideration of good electrical conductivity, springiness and the like.

As shown in FIG. 1A, the electrical connector of the first aspect of the invention corresponding to claim 1 comprises the insulator 12 and a plurality of contacts fixed to the insulator by press-fitting, hooking or any other anchoring means. Each of the contacts mainly consists of a contact portion 24 adapted to contact a mating contact, a fixed portion 26 to be fixed to the insulator 12, and a connection portion 28 to be connected to a circuit board or substrate and extending from the insulator 12 when assembled therein. While the contacts of straight dip type are shown in the illustrated embodiment, it will be apparent that contacts of other types such as surface mounting type (SMT) and L-shaped dip type may be used.

The insulator 12 comprises a main body 34 and projections 36 having contact insertion apertures 22 passing therethrough, and surfaces of the insulator around the contact insertion apertures 22 are metallized as shown by reference numerals 20. The term of "surfaces around the contact insertion apertures" used herein includes the upper surface 30 of the main body 34 and all side surfaces 31 of the projections 36. In this manner, the insulator 12 is partially metallized as shown by numerals 20, while the contact insertion apertures 22 themselves are independently or separately electrically insulated from the metallized portions and the contacts.

Such an arrangement of the metallized portions according to the invention makes it possible to be compatible two opposed states, that is, the conductivity by metallizing the insulator 12 and the independent insulation of the contact insertion apertures 22. In the illustrated embodiment, there are provided on the main body 34 of the insulator 12 a plurality of the externally metallized projections 36 in each of which one contact is arranged.

The contact insertion apertures 22 may be straight apertures extending through the insulator 12. Preferably, however, the contact insertion aperture includes an guide portion 38 with inclined faces on the side of a mating contact for assisting its fitting and a guiding aperture 40 with a smaller diameter than that of the contact insertion aperture 22 for guiding the mating contact.

A method for metallizing the insulator 12 will be explained hereinafter. The metallized surfaces 20 of the insulator 12 are surfaces coated with metallic films making the surfaces electrically conductive as described above. As the insulator 12 is made of an insulating material, its surfaces are metallized by treating with electroless plating, vapor deposition or the like to make the surfaces electrically conductive. Preferred materials to be used for the metallization include copper (Cu), nickel (Ni) and the like in consideration of the shielding effect, electrical conductivity and the like.

In order to independently electrically insulate the contact insertion apertures 22 from the metallized portions of the insulator, first the insulator 12 may be metallized as a whole with the exception of the contact insertion apertures. Thereafter, removed are the metallized surfaces on the side to be fitted with mating contacts and the metallized surfaces of the insulator which are peripheries of the contact insertion apertures from which the connection portions of the contacts extend outwardly, by the use of a removing method such as mechanical working by an end mill or grinding, blasting treatment, chemical etching or the like. As an alternative, such surfaces of the insulator not requiring the metallization are previously covered by masking before metallization in order to prevent from being metallized.

FIG. 2 illustrates an electrical connector 10 according to another aspect of the invention corresponding to claim 2. Only features of the connector shown in FIG. 2 different from those shown in FIGS. 1A and 1B will be explained. The electrical connector 10 shown in FIG. 2 comprises an insulator 12 including projections 36 each having a pair or two of contacts, one being a signal contact 14 and the other a phase inversion signal contact 16 which are fixed to the insulator 12. Each of the projections 36 includes a pair of contact insertion apertures into which the signal contact 14 and phase inversion signal contact 16 are inserted, respectively.

The metallization is also performed on the surfaces around pairs of the contact insertion apertures 22. The exact meaning of "surfaces of the insulator around . . . " is as defined above. Therefore, the insulator 12 is partly metallized, or metallized surfaces are partly removed to obtain independently electrically insulated contact insertion apertures in pairs. In this embodiment a plurality of the metallized projections 36 are also arranged on the main body 34 of the insulator 12. The procedure for metallizing the insulator and obtaining the independently insulated contact insertion apertures is substantially similar to that in the first aspect of the invention shown in FIG. 1A.

FIG. 3 illustrates an electrical connector 10 according to one embodiment of the invention corresponding to claim 3. In this embodiment, when the insulator 12 is metallized as a whole, the inner surfaces of the contact insertion apertures 22 or pairs of the apertures 22 are metallized at a time as shown in FIG. 3 and then the metallized inner surfaces of the apertures 22 may be removed together with other needless metallized surface portions. As a result, the contact insertion apertures 22 or pairs of contact insertion apertures 22 are independently electrically insulated. In other words, the inner surfaces of the contact insertion apertures 22 or pairs of the apertures 22 are once metallized besides the surfaces around the contact insertion apertures 22 or pairs of contact insertion apertures 22, and then the metallized inner surfaces of the contact insertion apertures 22 or pairs of apertures 22 are removed. The procedure for metallizing the insulator and obtaining the independently insulated contact insertion apertures is substantially similar to that described above.

FIG. 4 illustrates an electrical connector 10 according to a further aspect of the invention corresponding to claim 4. The electrical connector 10 comprises an insulator 12 and projections 36 each having three contacts therein. The three contacts are divided into two signal contacts 14 and a ground contact 18, all the contacts being fixed to the insulator 12. The insulator 12 includes the projections 36 each having three contact insertion apertures 22 for inserting three contacts.

In this case, surfaces around the three contact insertion apertures 22 of each of the projections 36 and their inner surfaces of the contact insertion apertures 22 at each of the projections 36 are once metallized. The metallized surfaces 20 are surfaces around the three contact insertion apertures 22 (the same as in the first aspect of the invention corresponding to claim 1) and the inner surfaces of the three contact insertion apertures 22 at each of the projections. All the three contact insertion apertures 22 are once metallized, but among them the two contact insertion apertures 22 for the signal contacts are independently electrically insulated.

In more detail, the two contact insertion apertures 22 for the signal contacts 14 are independently electrically insulated, while the remaining one contact insertion aperture 22 for the ground contact remains metallized so as to be electrically connected through the metallization to the frame ground thereabout. Although the three contacts in one projection are shown in the embodiment, it is to be understood that any numbers of contacts in one projection may be arranged according to designated specifications and cables. The numbers of contact insertion apertures to be independently electrically insulated may also be suitably determined according to specifications designated for connectors. The procedure for metallizing the insulator and obtaining the independently insulated contact insertion apertures is substantially similar to that described above.

FIG. 5 illustrates an electrical connector 10 according to a further embodiment of the invention substantially similar to the connector shown in FIG. 2 with respect to the arrangement of the insulator 12 and the contacts. In the illustrated embodiment, in addition to the metallized surfaces 20 of the electrical connector 10 shown in FIG. 2, the substantially flat surface of the main body 34 of the insulator 12 is entirely metallized as shown in FIG. 5. Depending upon designated specifications, the metallized surfaces are partly removed to make the contact insertion apertures independently electrically insulated. The procedure for metallizing the insulator and obtaining the independently insulated contact insertion apertures is substantially similar to that described above.

In accordance with designated specifications, the main body 34 of an insulator 12 is formed with apertures which are metallized and then into which pins are simply inserted, whereby desired grounding or earthing is accomplished with ease.

While the invention has been particularly shown and described with reference to preferred embodiments thereof, it will be understood by those skilled in the art that the foregoing and other changes in form and details can be made therein without departing from the spirit and scope of the invention.

What is claimed is:

1. An electrical connector including a plurality of contacts and a main body substantially in the form of a flat plate having upper, lower and side surfaces and a plurality of projections extending from said upper surface of said main body, wherein said main body and said plurality of projections are formed of an insulating plastic material, wherein contact insertion apertures pass from openings on the lower surface of said main body to openings on the outer surfaces of said plurality of projections to accommodate said plurality of contacts, and wherein at least a portion of said outer surfaces of said projections and said upper and side surface of said main body are metallized to provide electric shielding at high frequencies between said contacts.

2. The electrical connector as set forth in claim 1 wherein said insulator is metallized using a metal selected from the group consisting of Cu and Ni.

3. The electrical connector as set forth in claim 1 wherein said insulator is metallized using a method selected from the group consisting of electroless plating and vapor deposition.

4. The electrical connector as set forth in claim 1 wherein said insulating plastic material is selected from the group consisting of polybutylene terephthalate (PBT), liquid crystal polymer (LCP) polyphentlene sulfide (PBS), polyamide 46PA and polyamide 66PA.

5. The electrical connector as set forth in claim 1 wherein said contacts are made from a material selected form the group consisting of brass, phosphor bronze and beryllium copper.

6. The electrical connector as set forth in claim 1 wherein said lower surface of said main body is metallized, and wherein selected contact insertion apertures are electrically insulated from said metallized surfaces of said electrical connector by removing metal from areas of the lower surface of the main body and the outer surfaces of the projections peripheral the openings of said selected contact insertion apertures using a method selected from a group consisting of mechanical working by an end mill, grinding, blasting treatment and chemical etching.

7. The electrical connector as set forth in claim 1 wherein said lower surface of said main body is metallized and wherein selected contact insertion apertures are electrically insulated from said metallized surfaces of said electrical connector by preventing metal from being deposited on areas peripheral to said openings of said selected contact insertion apertures during metallization.

8. An electrical connector including a plurality of pairs contacts and a main body substantially in the form of a flat plate having upper, lower and side surfaces and a plurality of projections extending from said upper surface of said main body, wherein said main body and said plurality of projections are formed of an insulating plastic material, wherein pairs of contact insertion apertures pass from pairs of openings on the lower surface of said main body to pairs of openings on the outer surfaces of said plurality of projections to accommodate said plurality of pairs of contacts, and wherein at least a portion of said outer surfaces of said projections and said upper and side surfaces of said main body are metallized to provide electric shielding at high frequencies between said pairs of contacts.

9. The electrical connector as set forth in claim 8 wherein said insulator is metallized using a metal selected from the group consisting of Cu and Ni.

10. The electrical connector as set forth in claim 8 wherein said insulator is metallized using a method selected from the group consisting of electroless plating arid vapor deposition.

11. The electrical connector as set forth in claim 8 wherein said insulating plastic material is selected from the group consisting of polybutylene terephthalate (PBT), liquid crystal polymer (LCP) polyphentlene sulfide (PBS), polyamide 46PA and polyamide 66PA.

12. The electrical connector as set forth in claim 8 wherein said pairs of contacts are made from a material selected form the group consisting of brass, phosphor bronze and beryllium copper.

13. The electrical connector as set forth in claim 8 wherein said pairs of contacts comprise one signal contact and one phase inversion signal contact.

14. The electrical connector as set forth in claim 8 wherein said lower surface of said main body is metallized and wherein selected pairs of contact insertion apertures are electrically insulated from said metallized surfaces of said electrical connector by removing metal from areas of the lower surface of the main body and the outer surfaces of the projections peripheral to the pairs of openings of said selected pairs of contact insertion apertures using a method selected from a group consisting of mechanical working by an end mill, grinding, blasting treatment and chemical etching.

15. The electrical connector as set forth in claim 8 wherein said lower surface of said main body is metallized and wherein selected pairs of contact insertion apertures are electrically insulated from said metallized surfaces of said electrical connector by preventing metal from being deposited on areas peripheral to said selected pairs of contact insertion apertures during metallization.

* * * * *